US007357091B1

(12) United States Patent
Koslower

(10) Patent No.: US 7,357,091 B1
(45) Date of Patent: Apr. 15, 2008

(54) RAPID SELF-REPAIRING AND UNSINKABLE WATERCRAFT

(76) Inventor: Bernard Zeidler Koslower, 3600 NE. 170th St., Apt. D-200, North Miami Beach, FL (US) 33160

( * ) Notice: Subject to any disclaimer, the term of this patent is extended or adjusted under 35 U.S.C. 154(b) by 0 days.

(21) Appl. No.: 11/501,624

(22) Filed: Aug. 10, 2006

(51) Int. Cl.
*B63B 43/16* (2006.01)

(52) U.S. Cl. ..... 114/227; 114/229; 114/61.15; 114/61.16

(58) Field of Classification Search ..... 114/360, 114/227, 229, 125, 123, 283, 61.15, 61.16, 114/69
See application file for complete search history.

(56) References Cited

U.S. PATENT DOCUMENTS 650,333 A * 5/1900 Martens ..... 114/62
919,939 A * 4/1909 Otidys ..... 114/222
1,099,167 A * 6/1914 Czemiawski ..... 114/229
1,395,813 A * 11/1921 Geroianne ..... 114/229
1,573,909 A * 2/1926 Blumberg ..... 114/229
3,002,484 A * 10/1961 Dube ..... 114/61.16
3,097,372 A * 7/1963 Barrie ..... 114/344
3,183,876 A * 5/1965 Kronhaus ..... 114/229
3,531,809 A * 10/1970 Hegg ..... 114/357
4,804,210 A * 2/1989 Hancock ..... 285/47
4,993,350 A * 2/1991 Pepper ..... 114/292
5,003,908 A * 4/1991 Wilson ..... 114/229
5,630,895 A * 5/1997 Zeidler ..... 156/71

FOREIGN PATENT DOCUMENTS

JP 2-262492 * 10/1990

OTHER PUBLICATIONS

Translation of Japan 2-262492.*

* cited by examiner

*Primary Examiner*—Sherman Basinger
(74) *Attorney, Agent, or Firm*—Judi Adele Plotkin

(57) ABSTRACT

A self-repairing and unsinkable watercraft has the hull of the mid section of the craft covered by two moveable water impermeable sheaths. The sheaths rotate in opposite directions to temporarily seal a breach and to allow for better ease of permanent repair or replacement. In one preferred embodiment, the craft is fitted on each side with at least one pontoon-like sealed foam structure that is attached by moveable telescoping arms. Adjustment of the positions of these structures with arm movement provides for greater stability of the craft during various maneuvers, aids in keeping the craft upright, and adjusts for changes in buoyancy and lift as needed. When additional stability is wanted, the craft contains a layer of sealed foam beneath the main deck at or above the waterline and from one to three submerged cylinders that are opened or closed to the water at both ends as needed.

19 Claims, 5 Drawing Sheets

RAPID SELF-REPAIRING AND UNSINKABLE WATERCRAFT

BACKGROUND OF THE INVENTION

The present invention relates to improvements in the performance and durability of watercraft such as boats, ships, tankers, etc. through the use of hull sheaths, foam layer buoyancy, water filled open cylinder stabilizing of crafts, and moveable pontoon adjustments to buoyancy and stability. No art was located that disclosed double sheath hull covering configurations.

Maklezow, in US application 20040149197, describes an integrated, compartmentalized, water impermeable hull that is constructed of a plurality of lengthwise tubes sandwiched between two support layers. The tubes are parallel and in contact, each with at least one other. They are not intended to be filled with water nor open to the ambient water.

Many unsinkable structures are provided with inflatables for temporary remediation until rescue or repair can be effected. Examples include U.S. Pat. Nos. 6,758,158, 6,550,415, 6,431,108, and 6,408,782. Wenstob et al. in U.S. Pat. No. 4,919,067 uses a combination of rigid and reversibly inflatable pontoons for both unsinkability and self-righting. The system is permanent and reusable.

Jones, et al., in U.S. Pat. No. 4,541,356 describes a multihull vessel capsize prevention device including first and second tubes disposed longitudinally along the lower portion of the keel of the vessel through which seawater flows during the sailing of the vessel. Each of the tubes includes forward and rearward watertight valves. The mass of the water within the tubes serves to prevent capsize about one of the outriggers of the vessel. These cylinders are used for a multihull craft and not in conjunction with other stabilizing means such as pontoons or sealed foam layers. Further they are not adjacent the hull but attached at a distance below the multihull craft.

Seidel in U.S. Pat. No. 6,327,988 describes a watercraft with multiple buoyancy chambers in the deck of the craft. Under normal operation each chamber is filled with air. In case of a breach or other high risk situation, chambers then are filled with a closed cell foam to counteract any loss in buoyancy. Hence the foam is used only during periods of emergency and is dependent on the foam producing mechanism working in a timely fashion during an emergency in order to be effective.

Berg, et al., in US application 20020092453 describe a rolling multiple cover assembly for a barge. The use of multiple covers prevents damage to the cargo should one of the covers become damaged. The covers are to insure protection of the barge cargo and do not provide protection to the barge itself per se neither above nor below the water.

Hill, et al. in US application 20030084834 describes an apparatus for protecting a hull of a watercraft that includes a waterproof shroud of flexible sheet material suspended from a collar which is floatable. This single shroud appears to be intended to provide a protective enclosure during mooring and not during use of the craft.

Rice in U.S. Pat. No. 6,755,142 and US application 20030121463 describes a modular pontoon system made of air filled modules combined to form a single pontoon. There is no suggestion to fill the modules with foam.

Trepanier in US applications 20040079270 and 20040040488 describes a pontoon shell filled with multiple segments of filler that can be closed cell foam. It may also include a ballast section. No details are given as to methods of usage nor of attachment to watercraft.

None of the background art describes a moving hull sheath system. Neither does the art use sealed foam layers below the deck and/or cylinders open to the water attached to monohull craft. Hence there is considerable need for a method of rapid damage repair along with means for increased stability and 'unsinkability'.

BRIEF SUMMARY OF THE INVENTION

The present invention provides for more rapid self-repair of hull damage through the use of a double sheath construct of water impermeable material. Each sheath can be rotated in a direction opposite to the other in order to provide two layers of undamaged sheath material to cover and seal any damaged area while more permanent repairs are made. In one embodiment, the sheaths are mounted on spindles at each end above the waterline.

Further the novel unsinkable and self-repairing watercraft of this invention is fitted on each side with at least one pontoon-like sealed foam structure made with a water impervious coating layer. In one embodiment these structures are attached by moving telescoping arms that can adjust the location of the structures with respect to the height, the width, and the length of the craft in order to maintain the craft in an upright position.

Since the at least two pontoon-like structures included in the present invention are independently moveable by attached telescoping arms, they provide a means to adjust for changes in buoyancy and lift to the craft or parts of the craft.

A cleaning system can be placed on the hull sheaths and/or the pontoon-like structures. It can be automated with vertical and horizontal movement adjustments along the outsides of the structures and the outside sheath. This system will reduce the likelihood of sheath and hull breaches due to normal use.

Furthermore, the present invention provides a cleaning mechanism that can be automated for scheduled and/or continuous cleaning of the sheath material. The mechanism travels in both horizontal and vertical modes along the outsides of the craft as required for optimal maintenance.

An additional feature of an embodiment of this invention includes at least one open cylinder at the inside bottom of the craft or beneath the hull to provide additional stability to the craft. The one to three or more double walled cylinders can be opened or closed at both ends while filled with the ambient water.

Further, above the cylinder(s), approximately at the water line is a layer of sealed foamed material that does not absorb any significant amount of water even if submerged for extended periods of time at depths of 60-100 feet of water. For maximizing stability, the craft contains this layer of sealed foam beneath the main deck at the level of the waterline present when the craft is at rest in calm water.

Hence this invention provides for improvements over the present state of watercraft in self-repair and in self-cleaning. These improvements can be accomplished manually or in an automated fashion through the use of sensor feedback, computer controls, and robotic attachments.

This invention provides in a novel way for more rapid self-repair than in presently known watercraft.

Further, this invention can be adapted to retro fit some present day watercraft for improvements in stability, in maintenance, and/or in repair.

DETAILED DESCRIPTION OF THE INVENTION

The present invention provides for more rapid self-repair of hull damage through the use of a double sheath construct of water impermeable material. Each sheath can be rotated in a direction opposite to the other in order to provide two layers of undamaged sheath material to cover and seal any damaged area while more permanent repairs are made. The sheaths may be made of any flexible and easily handling material such as certain rubbers e.g. fiber or steel reinforced rubbers, sealed foams, and resilient metal foils. They are thin enough to be rolled onto spindles for storage and for use. It is envisioned that sheaths for typical use will range from about one half to two inches in thickness. Lightweight materials are preferred for ease of transport and ease of rolling onto the axles or spindles.

In one embodiment, the sheaths are mounted on spindles at each end above the waterline. While these spindles can be mounted on the main deck, it is often preferable to have them mounted above the waterline on a lower deck along with maintenance equipment such as for cleaning and repair tasks. Both automated and manual systems of maintenance equipment can be provided depending on the optimal needs of any given craft. Spare rolls of the sheath material can be stored in the watercraft in order to allow for ease of replacement of a roll with sheath material that has been extensively damaged and that can not be fully and/or rapidly repaired in situ.

The double sheath configuration requires two spindles on either side of the craft. The inner sheath is rolled onto the pair of spindles closer to the sides of the craft, whereas the outer sheath is rolled onto the inner placed spindles that are further from the sides of the craft. In situ maintenance work on the inner sheath is most easily accomplished in the area near the spindle locations. However, it is reasonably expected that more maintenance work will be needed for the outer sheath due to the outer sheath's constant exposure to the elements such as marine minerals and sea life. Hence in addition to maintenance work near the spindle locations, an external cleaning and/or minor repair system can be provided.

Figure 1:
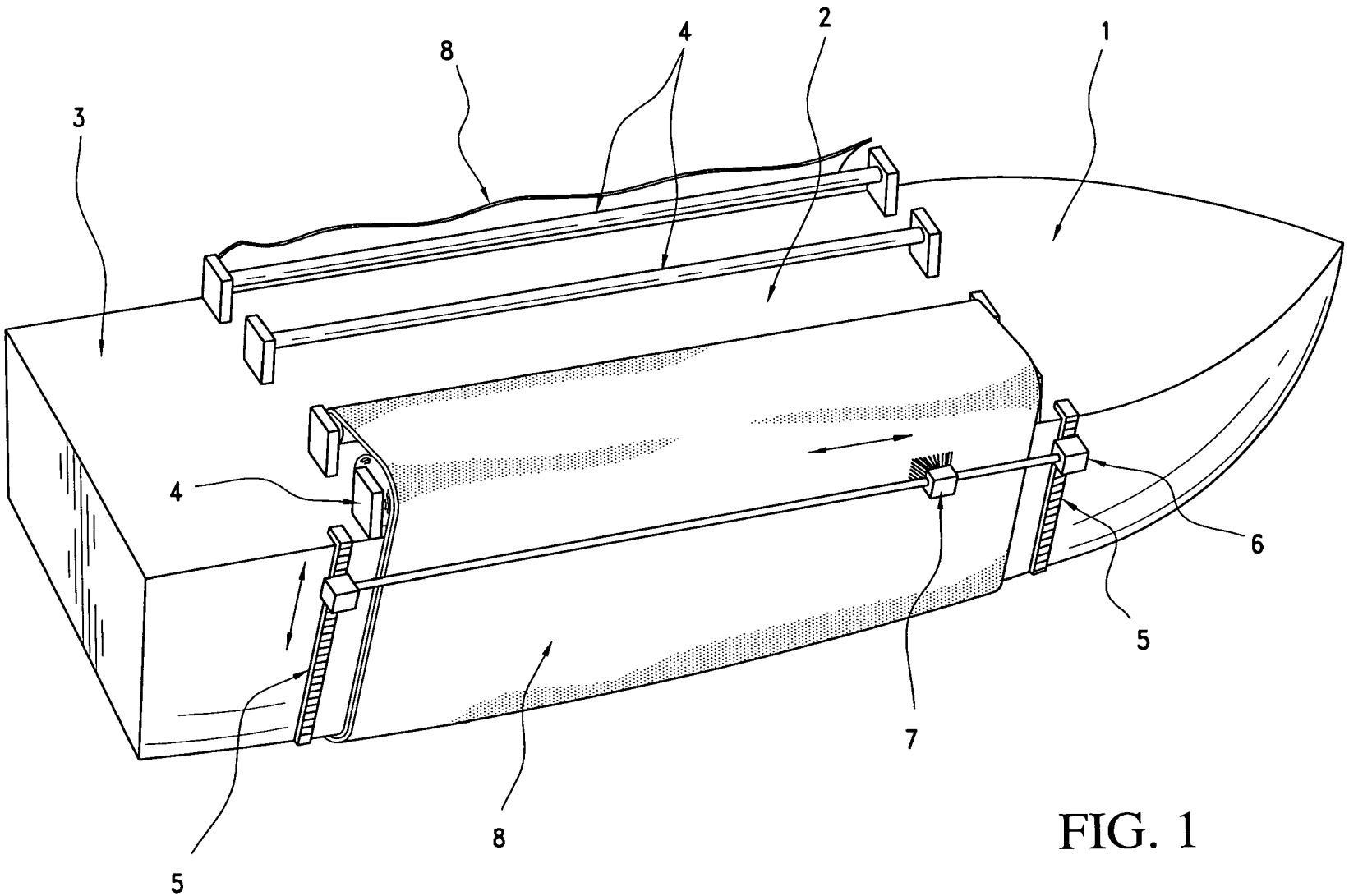
FIG. 1 depicts some features of a watercraft with a fore [1], a mid [2], and an aft [3] section in which the mid section [2] has mounted spindles [4] used at the ends of the hull sheaths [8] to rotate the sheaths in an appropriate direction as needed. Also depicted is one embodiment of a cleaning system [7] with horizontal [6] and vertical [5] tracks or bars on which the cleaning device can travel.

FIG. 1 depicts some features of a watercraft with a fore [1], a mid [2], and an aft [3] section in which the mid section [2] has axles or spindles [4] at the ends of the hull sheaths [8] and mounted above the waterline. These spindles [4] are used to rotate the sheaths in an appropriate direction as needed. The two spindles [4] on the far side of the craft are depicted without the rolls of sheaths on them. The spindle on the near side of the craft is depicted with a roll of an outer sheath [8] on it.

Furthermore, the present invention provides an optional cleaning mechanism that can be automated for scheduled and/or continuous cleaning of the sheath material. The mechanism can travel in both horizontal and vertical modes along the outsides of the craft as required for optimal maintenance. Also depicted in FIG. 1 is one embodiment of an external cleaning system [7] with horizontal [6] and vertical [5] tracks or bars on which the cleaning device can travel along the outside of the outer sheath on one side of the craft. Hence, in this embodiment, there is also a second such cleaning system on the other side of the craft. Such a cleaning system [7] is optionally also equipped to perform minor maintenance repairs in situ as well as inspection, brushing, and/or other cleaning tasks.

The cleaning system can be placed on the hull sheaths and/or pontoon-like structures attached to the craft as described in greater detail below. In the automated embodiment, the system is equipped with a means for vertical and horizontal movement adjustments along the outsides of the structures and/or the outside sheath. The combination of a mobile cleaning system and the rolling of the sheaths in opposite directions at a predetermined speed and/or intervals allows for optimal cleaning, maintenance, and/or minor repair in a continuous fashion. This system reduces the likelihood of sheath and hull damage due to normal use.

Figure 8:
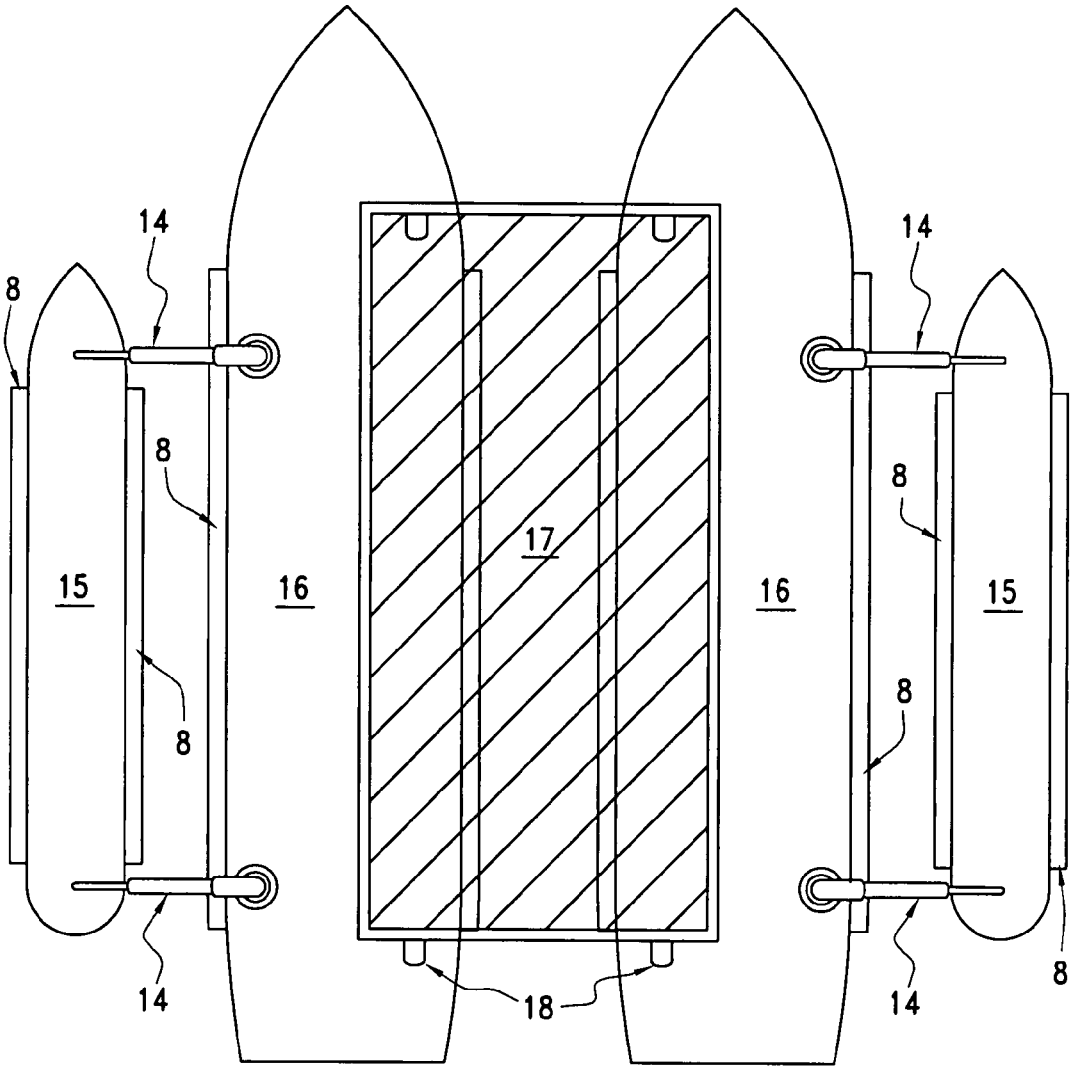
FIG. 8 depicts an embodiment of the present invention that provides for the attachment of two watercraft modules with the sheath system [8]. The attachment is through a bridging construct [17] that is elevated by some means [18] above the deck level [16]. For greater stability, at the far right and left sides are attached pontoon-like structures [15] through moveable telescoping arm mechanisms [14] along with respective sheath systems [8] for the pontoon-like structures [15].

While the above described double sheath construct (as seen in FIGS. 1 and 8) and cleaning systems (as seen in FIG. 1) are conceived for use with newly made, lightweight watercraft or pontoon-like structures, such systems are also adaptable for use with some existing watercraft and/or pontoon structures. Such a retrofit of existing structures provides improvements in repair, cleaning and maintenance.

Newly made craft preferably are made, as much as feasible, from lightweight materials such as fiberglass. Exposed surfaces may be sealed with sealed foam or polymeric material in a fashion as described by this same inventor in U.S. Pat. No. 5,630,895. U.S. Pat. No. 5,630,895 is therefore incorporated herein en toto by reference. Briefly, surfaces and surfaces of foams are sealed by a method to fuse polymeric fibers in situ into a highly weather resistant, seamless covering layer comprising:

A) placing a fiber layer comprised of said fibers over the surfaces in need of being sealed;

B) optionally covering said fiber layer with an air-impermeable overlayer of high temperature tolerant material;

C) concurrently compressing and fusing said fiber layer by in situ exposure through said air-impermeable layer to high temperatures adequate to uniformly melt and fuse said fibers into a waterproof layer on said surfaces; and D) optionally removing said overlayer once melting, fusion, compression and drying have been completed.

The watercraft is propelled in any known fashion. Given the environmental and energy concerns of the present day, it is preferred that the energy to run and to propel the craft comes from renewable energy sources. Generators are powered by solar energy, wind energy, and/or hydro energy as known in the art. For example, U.S. Pat. No. 6,293,835 describes useful turbines powered by wind and/or wave motion. The craft may be fitting with sail riggings if so desired. One preferred embodiment uses high rpm electrical aircraft engines such as with propeller propulsion. Thrust direction can be changed through adjustment of vent size and direction or propeller angle. In a propeller embodiment, the propeller(s) is mounted on the aft section of the craft above the waterline. One or more underwater propellers with variable thrust direction capacity are optionally provided to help with steering and for slower travel such as when needed in ports. Some of the other recent prior art describing such environmentally friendly methods of propulsion include U.S. Pat. Nos. 6,036,443, 6,128,903, 6,155,892, 6,253,700, 6,341,571, 6,561,856, 6,887,115, 6,902,447, 6,953,000, 7,047,902, 7,052,339, and US applications 20060112691, 20050269821, 20050215129, 20050025624, 20040202905, 20030077493, and 20020182946.

Figure 2:
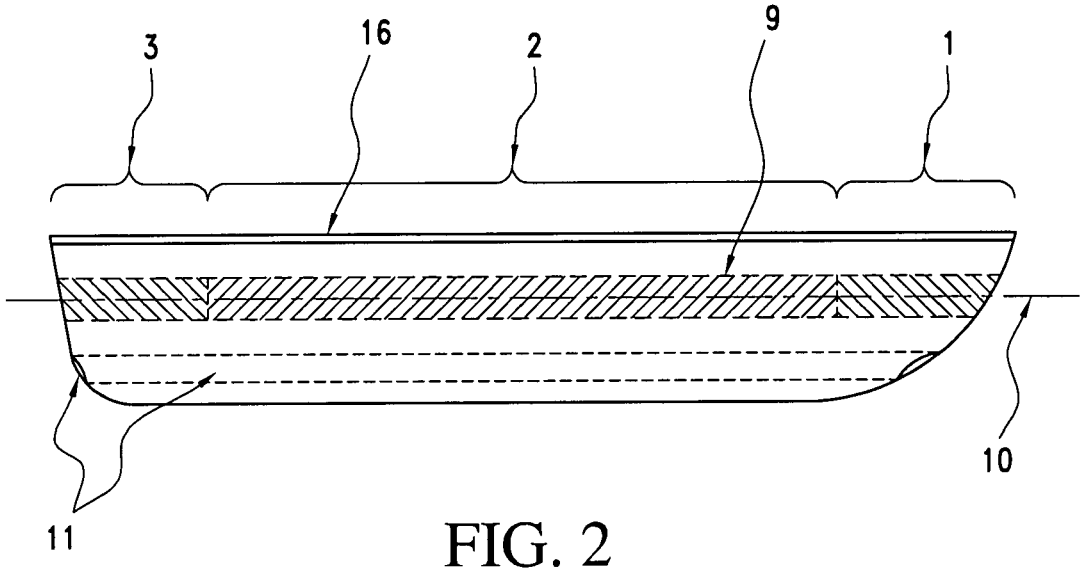
FIG. 2 is a side view of a watercraft showing the location of a sealed foam layer [9] at or just above the waterline [10] in combination with a double walled cylinder [11] that can be opened to the ambient water at both ends. In this embodiment, the cylinder is contained within the craft with openings for water flow in the fore [1] and aft [3] sections.
Figure 3:
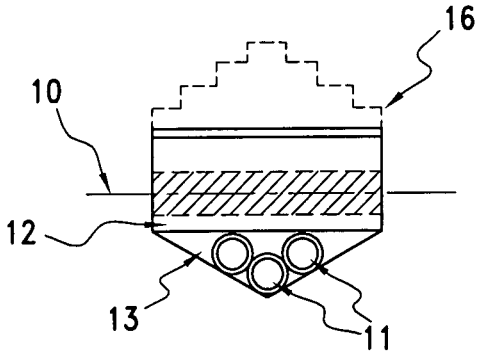
FIG. 3 is a frontal view of another embodiment of a watercraft containing three cylinders [11] opened to the ambient water.
Figure 4:
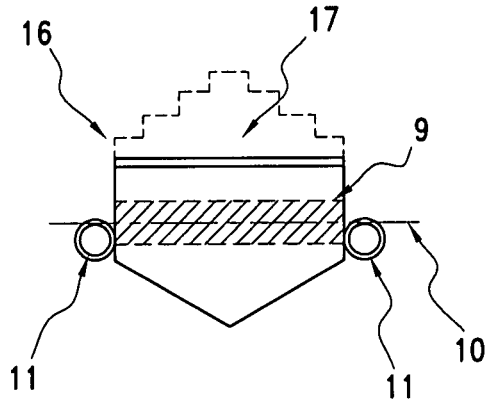
FIG. 4 depicts a third embodiment where there are two cylinders [11] attached outside the craft along the sides just below the waterline.

The number of levels present in the watercraft of this invention vary according to the needs of the embodiments. In some embodiments, multiple levels are above the waterline [as seen in FIG. 4, #17] and/or below the waterline [as seen in FIG. 3, #'s 12-3]. The number and arrangement of the levels will be determined by the needs for crew and passenger quarters and recreational spaces, work spaces, propulsion equipment areas, maintenance equipment areas, storage and cargo areas, and so forth. Depending on empty craft weight distribution and loaded craft load weight distribution, and in order to optimize stability and buoyancy, unsinkable watercraft of the present invention contain a variable sized layer of sealed foam [9] below the main deck [16] at or slightly above the waterline [10] present when the craft is at rest in calm waters as depicted in FIG. 2. In one embodiment, this layer [9] extends the entire length of the craft below the main deck [16]. However, another embodiment allows for the presence of ballast sections, if needed, at the same level in the fore [1] section of the craft with the sealed foam layer present completely through the mid section [2] and preferably through the aft [3] section as well. The sealed foam layer is preferably provided in independent sealed modular segments to be placed as necessary around conduits and constructs needed for proper craft functioning of sealed hatchways between levels and sections, for cable and wiring conduits, for crawlspaces, for pipework and tubes, and so on. Additionally, the fore, mid, and aft sections have sealing hatchways separating the levels and sections. Then damage in one section and/or level does not easily affect the integrity of the other sections and/or levels. Similarly, if desired, each of the sections can be divided into sub-sections likewise sealed off from one another.

The sealed foam is preferably sealed according to the method of U.S. Pat. No. 5,630,895 as described above. Sealed foam preferred for use will have a support capacity of at least one ton per cubic meter. However, this varies according to the density of the foam and the method of manufacture. Some applications do not need as much support capacity.

Tests on 100-120 kilo blocks of foam sealed according to the method of U.S. Pat. No. 5,630,895 were conducted by submergence under heavy weights at 60 to 100 feet of water for about a year. Different sets of blocks were enclosed in different materials such as plastic foil, metal foil, wood, etc. One set of blocks was not enclosed at all. Upon removal of the heavy weights, all blocks rapidly popped up to the surface of the water. Unenclosed or poorly enclosed blocks showed adverse signs of prolonged exposure to typical waterway conditions such as from plant and animal life, mineral deposits, and so on. All blocks showed less than half a kilo of water absorption despite the length of time and depth of exposure.

Along with the sealed foam layer, the watercraft of this invention have an attached cylinder or cylinders able to be opened to the water at both ends and located below the waterline. The at least one cylinder extends from the fore section to the aft section with ends attached to the craft at the fore and aft sections. The doors for opening the ends are optionally hydraulically operated. One embodiment of such a cylinder's placement is depicted in FIG. 2. The cylinder [11] extends across the bottom and within the craft the entire length of the craft from the fore section [1] to the aft section [3], well below the waterline [10].

Another embodiment is seen in FIG. 3. Instead of one cylinder, multiple cylinders can be packed within the craft at the bottom well below the waterline [10] and the layer of sealed foam [9] below the deck [16]. In this embodiment, three such cylinders [11] are seen from a frontal view. The area around them [13] can be divided into compartments and used for ballast, maintenance, and other tasks as needed or desired. Above the area containing the cylinders [11] is another multi-use area [12] that can be used for additional ballast, for cargo areas, for maintenance equipment, and for any other use deemed appropriate. Like the lower area [13], this area [12] can also be divided into multiple compartments sealed off from one another through sealed hatches or like devices.

Figure 5:
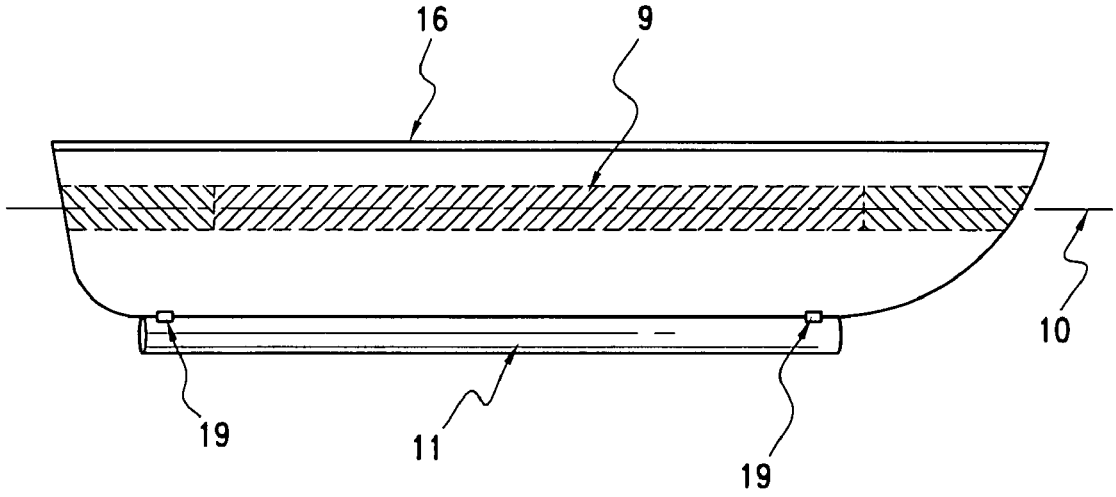
FIG. 5 displays yet a fourth embodiment with a cylinder [11] attached at the aft and fore sections [19] beneath the watercraft's hull.
Figure 6:
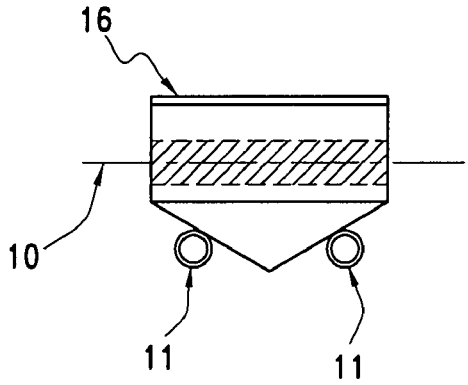
FIG. 6 is a frontal view of a two cylinder [11] embodiment depicting that the cylinders can be at varying depths along the sides of the watercraft.
Figure 7:
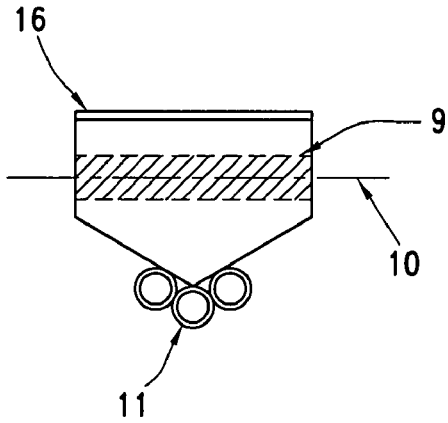
FIG. 7 depicts yet another embodiment with several cylinders [11] located beneath the hull of the watercraft.

Other embodiments of cylinder [11] placement are seen in FIGS. 4-7. FIG. 4 shows cylinders [11] on either side of the craft just below the waterline. FIG. 6 shows that the placement of these cylinders [11] can be moved to any depth along the sides of the craft. FIG. 5 shows one such cylinder [11] beneath the bottom of the craft. Like all the cylinders herein described, the ends of this cylinder are attached to the craft at both fore and aft sections of the craft by a means of attachment [19]. FIG. 7 shows a frontal view of such a cylinder as seen in FIG. 5 along with two other cylinders clustered right above the first along the outsides of the craft.

Any appropriately water impermeable, sturdy and durable materials are used for the cylinders such as aluminum, steel, rubber, etc. A preferred embodiment has the cylinders double walled with a layer of sealed foam between the two walls. For ease of placement and better maintenance of integrity, the sealed foam is preferably present in multiple, independently sealed segments.

Figure 9:
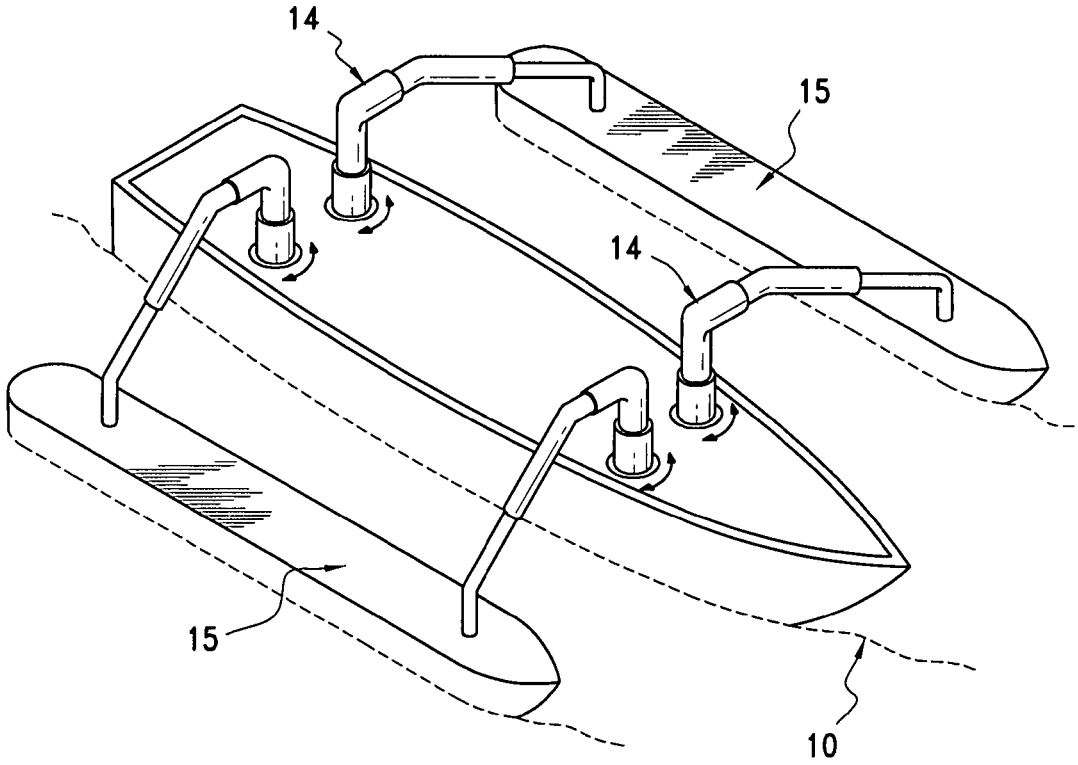
FIG. 9 depicts the single watercraft embodiment with the pontoon-like structures [15] on either side, also attached by way of moveable telescoping arm mechanisms [14].

The watercraft of this invention can further include at least one pontoon-like structure on either side of the craft. Some embodiments of the craft have a single hull structure as seen in FIG. 9. Other embodiments contain multiple modules of watercraft linked together through upper decks or elevated bridges [17] as seen in the two module embodiment of FIG. 8. Pontoon-like structures [15] are attached by telescoping arms [14] that allow for adjusting the location of the pontoon-like structures [15] with respect to the height, width and length of the watercraft. In the multi-modular configuration, the connecting upper decks or bridges [17] are elevated in some manner [18] above the lower deck level [16] where the axles or spindles are placed for the rolling the sheaths [8] along the hull of each module. Should the modular configuration be too wide for maneuverability in a small port, or should the depth of the craft below the waterline be too deep for a shallow port, the craft can be anchored outside of the port and transport of people and cargo can be achieved with shuttle boats.

The pontoon-like structures along the sides of the watercraft are typically about two thirds the length of the craft. They have the general shape of a torpedo. However, for certain applications, the lower section of the pontoon-like structure is shaped like a ski. The pontoon-like structures are filled with a foam sealed by the method of U.S. Pat. No. 5,630,895 as described above. Preferably, the structures are filled with independently sealed pieces of foam. One preferred embodiment has side-by-side multiple pieces of sealed foam extending the length of the pontoon-like structure and encased in a water resistant covering layer. In another embodiment, the pontoon-like structures have double sheath constructs similar to that present on the hull of the watercraft depicted in FIG. 1 as described above and as indicated in FIG. 8. They optionally also can include a cleaning system for the sheaths as described above.

Attachment of the pontoon-like structures to the craft is through telescoping arms mounted on towers on the deck with crane-like mechanisms. The tower tops are well above the axles or spindles needed for the rolls of sheaths so as not to interfere with the motion of the rolls of sheaths and maintenance thereof. The arms help in moving the pontoon-like structures around as needed, for instance up and down to help in maintaining balance and stability during turns. Further, the mobility of the pontoons can help prevent capsizing of the craft when the pontoon-like structures are moved in an appropriate fashion. With appropriate ballast means included in the craft construction, the pontoon-like structures can be part of a self-righting system similar to that described in U.S. Pat. No. 4,919,067 by Wenstob.

Another use for the moving arms is seen in some applications. In these applications, the bottoms of the pontoon-like structures are more like skis in shape. With high thrust from the propulsion system, the pontoon-like structures are lowered into the water resulting in raising of the craft slightly above the water level and forward motion occurs balanced on the ski shaped pontoon-like structure. Final speed achieved will be the result of the combination of effects from load weight distribution of the craft, changes in drag, changes in buoyancy, and changes in speed.

Some watercraft can be retrofitted with pontoon-like structures of this invention. The tower cranes with telescoping arms can serve additional functions during a retrofit. For instance, the arms can help in the placement of temporary patches for hull punctures or breaches, such as sealing rubber gaskets or magnetically held metal plates. Further, these arms can temporarily secure them against the hull until more effective sealing can be achieved. Several patents suggest various means for hull patching that could benefit from the presence of a moveable arm system. They include, among others, U.S. Pat. Nos. 5,927,223, 5,782,196, 5,162,064, and 5,245,941.

In combination, the pontoon-like structures along with the layer of sealed foam at or just above the waterline level and the open cylinder(s) below the waterline provide for improved stability, unsinkability, and resistance to capsizing. This is further enabled by the double sheath self-repair system that better maintains hull integrity and eliminates or greatly reduces influences that would cause risks for sinking.

The embodiments described above and in the claims that follow are illustrative of the novel features of this invention. Although the preferred embodiments of the present invention have been fully described with reference to the accompanying drawings, various changes and modifications are apparent to those skilled in the art. Such changes and modifications are to be understood as within the scope of the present invention as defined by the appended claims, unless they depart therefrom.

What is claimed is:

1. A self-repairing watercraft comprising:

A) a fore section,

B) a mid section with a height, a length, and a width,

C) an inner first moveable water impermeable sheath mounted on said mid section and able to be rotated for better ease of repair or replacement, D) an outer second moveable water impermeable sheath mounted on said mid section, at least partially overlapping said first sheath on said mid section below the waterline, and able to be simultaneously rotated in a direction opposite to that of said first sheath in order to temporarily seal a breach and to allow for better ease and speed of repair or replacement, E) an optionally automated means to rotate said first sheath and said second sheath, F) two sides, and G) an aft section.

2. A watercraft as described in claim 1 further comprising:

A) at least two pontoon-like structures filled with sealed foam attached to said watercraft wherein at least one of said structures is attached at each of said two sides of said watercraft, B) a means for attaching said structures to said mid section, and C) a means for adjusting the location of said structures with respect to said height, said length and said width of said mid section.

3. A watercraft as described in claim 2 wherein said sealed foam is sealed with a layer of polymeric fibers fused and compressed on all surfaces into a highly weather resistant, seamless covering layer.

4. A watercraft as described in claim 2 wherein said structures are covered below the waterline by the sheaths of a pontoon double sheath system comprising:

A) an inner first moveable water impermeable pontoon sheath of said pontoon double sheath system able to be rotated for better ease of repair or replacement, B) an outer second moveable water impermeable pontoon sheath of said pontoon double sheath system, at least partially overlapping said first pontoon sheath, and able to be rotated simultaneously in a direction opposite to that of said first pontoon sheath of said pontoon double sheath system in order to temporarily seal damage and to allow for better ease and speed of repair or replacement, and C) an optionally automated means to rotate said first pontoon sheath of said pontoon double sheath system and said second pontoon sheath of said pontoon double sheath system.

5. A watercraft as described in claim 4 further comprising an optionally automated cleaning system for said pontoon double sheath system.

6. A watercraft as described in claim 1 further comprising an optionally automated cleaning system for said double sheath system.

7. A watercraft as described in claim 1 further comprising a layer of surface sealed foam at or slightly above the waterline when said watercraft is at rest in calm water and not being propelled, wherein said surface sealed foam is sealed with a layer of polymeric fibers fused and compressed on all surfaces into a highly weather resistant, seamless covering layer and wherein said surface sealed foam absorbs less than about half a kilo of water per 100 kilos of foam after submersion at water depths of 60 to 100 feet for about a year.

8. A watercraft as described in claim 1 further comprising at least one cylinder openable to the water located along the length of said watercraft below the waterline when said watercraft is at rest in calm water and not being propelled.

9. A water vehicle comprising:

A) a watercraft with a height, a width and a length and comprising a hull with two sides, B) a means to easily and speedily repair breaches in said hull comprising a continuously sheathed mid-section of said hull below the waterline, C) at least two pontoon-like structures filled with surface sealed foam and attached to said watercraft wherein at least one of said structures is attached at each of said two sides of said watercraft, D) a means for reversibly attaching said structures to said watercraft, and E) a means for adjusting the location of said structures with respect to said height, said width and said length of said watercraft wherein said surface sealed foam is sealed with a layer of polymeric fibers fused and compressed on all surfaces into a highly weather resistant, seamless covering layer.

10. A watercraft as described in claim 9 wherein said structures are covered below the waterline by the sheaths of a pontoon double sheath system comprising:

A) an inner first moveable water impermeable pontoon sheath of said pontoon double sheath system able to be rotated for better ease of repair or replacement, B) an outer second moveable water impermeable pontoon sheath of said pontoon double sheath system, at least partially overlapping said first pontoon sheath, and able to be rotated simultaneously in a direction opposite to that of said first pontoon sheath of said pontoon double sheath system in order to temporarily seal damage and to allow for better ease and speed of repair or replacement, and C) an optionally automated means to rotate said first pontoon sheath of said pontoon double sheath system and said second pontoon sheath of said pontoon double sheath system.

11. A water vehicle as described in claim 10 further comprising an optionally automated cleaning system for said pontoon double sheath system.

12. A water vehicle as described in claim 9 further comprising a layer of said surface sealed foam at or slightly above the waterline when said water vehicle is at rest in calm water and not being propelled, wherein said surface sealed foam absorbs less than about half a kilo of water per 100 kilos of foam after submersion at water depths of 60 to 100 feet for about a year.

13. A water vehicle as described in claim 9 further comprising at least one cylinder openable to the water located along the length of said water vehicle below the waterline when said water vehicle is at rest in calm water and not being propelled.

14. A water vehicle as described in claim 9 wherein said means to repair breaches in said hull has said hull covered below the waterline with the sheaths of a double sheath system comprising A) an inner first moveable water impermeable sheath mounted on said mid section and able to be rotated for better ease of repair or replacement, B) an outer second moveable water impermeable sheath mounted on said mid section, at least partially overlapping said first sheath, and able to be simultaneously rotated in a direction opposite to that of said first sheath in order to temporarily seal a breach and to allow for better ease and speed of repair or replacement, and C) an optionally automated means to rotate said first sheath and said second sheath.

15. A water vehicle comprising:

A) a watercraft with a height, a width and a length and comprising a hull with two sides, B) a means to easily and speedily repair breaches in said hull, C) at least two pontoon-like structures filled with sealed foam and attached to said watercraft wherein at least one of said structures is attached at each of said two sides of said watercraft, D) a means for reversibly attaching said structures to said watercraft, E) a means for adjusting the location of said structures with respect to said height, said width and said length of said watercraft; and F) a pontoon double sheath system comprising:

a) an inner first moveable water impermeable pontoon sheath of said pontoon double sheath system able to be rotated for better ease of repair or replacement, b) an outer second moveable water impermeable pontoon sheath of said pontoon double sheath system, at least partially overlapping said first pontoon sheath, and able to be rotated simultaneously in a direction opposite to that of said first pontoon sheath of said pontoon double sheath system in order to temporarily seal damage and to allow for better ease and speed of repair or replacement, and c) an optionally automated means to rotate said first pontoon sheath of said pontoon double sheath system and said second pontoon sheath of said pontoon double sheath system.

16. A water vehicle as described in claim 15 further comprising an optionally automated cleaning system for said pontoon double sheath system.

17. A water vehicle as described in claim 15 further comprising a layer of said sealed foam at or slightly above the waterline when said water vehicle is at rest in calm water and not being propelled, wherein said sealed foam is sealed with a layer of polymeric fibers fused and compressed on all surfaces into a highly weather resistant, seamless covering layer and wherein said sealed foam absorbs less than about half a kilo of water per 100 kilos of foam after submersion at water depths of 60 to 100 feet for about a year.

18. A water vehicle as described in claim 15 further comprising at least one cylinder openable to the water located along the length of said water vehicle below the waterline when said water vehicle is at rest in calm water and not being propelled.

19. A water vehicle as described in claim 15 wherein said means to repair breaches in said hull has said hull covered below the waterline with the sheaths of a double sheath system comprising A) an inner first moveable water impermeable sheath mounted on said mid section and able to be rotated for better ease of repair or replacement, B) an outer second moveable water impermeable sheath mounted on said mid section, at least partially overlapping said first sheath, and able to be simultaneously rotated in a direction opposite to that of said first sheath in order to temporarily seal a breach and to allow for better ease and speed of repair or replacement, and C) an optionally automated means to rotate said first sheath and said second sheath.

* * * * *